US010106903B2

(12) United States Patent
Motsegood et al.

(10) Patent No.: US 10,106,903 B2
(45) Date of Patent: Oct. 23, 2018

(54) CONSUMABLE ANODE AND ANODE ASSEMBLY FOR ELECTROLYTIC REDUCTION OF METAL OXIDES

(71) Applicants: Perry N. Motsegood, Shorewood, IL (US); James L. Willit, Batavia, IL (US); Mark A. Williamson, Naperville, IL (US); Stanley G. Wiedmeyer, Glen Ellyn, IL (US); Eugene R. Koehl, Joliet, IL (US)

(72) Inventors: Perry N. Motsegood, Shorewood, IL (US); James L. Willit, Batavia, IL (US); Mark A. Williamson, Naperville, IL (US); Stanley G. Wiedmeyer, Glen Ellyn, IL (US); Eugene R. Koehl, Joliet, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 234 days.

(21) Appl. No.: 15/064,106

(22) Filed: Mar. 8, 2016

(65) Prior Publication Data

US 2017/0260635 A1 Sep. 14, 2017

(51) Int. Cl.

| | |
|---|---|
| ***C25C 7/00*** | (2006.01) |
| ***C25C 7/02*** | (2006.01) |
| ***C25C 1/22*** | (2006.01) |
| ***C25C 7/06*** | (2006.01) |
| *C25C 3/34* | (2006.01) |

(52) U.S. Cl.
CPC ..... *C25C 7/007* (2013.01); *C25C 1/22* (2013.01); *C25C 7/02* (2013.01); *C25C 7/06* (2013.01); *C25C 3/34* (2013.01)

(58) Field of Classification Search
None
See application file for complete search history.

(56) References Cited

U.S. PATENT DOCUMENTS

| | | | | | |
|---|---|---|---|---|---|
| 4,288,305 | A * | 9/1981 | Garritsen | C25C 1/00 | 205/587 |
| 4,338,177 | A * | 7/1982 | Withers | C25C 3/12 | 204/245 |
| 4,409,073 | A * | 10/1983 | Goldberger | C25C 7/025 | 204/228.1 |
| 4,421,830 | A * | 12/1983 | Schneider | H01M 6/04 | 429/113 |
| 4,995,948 | A * | 2/1991 | Poa | C25C 3/34 | 204/241 |

(Continued)

*Primary Examiner* — Harry D Wilkins, III
(74) *Attorney, Agent, or Firm* — Cherskov Flaynik & Gurda, LLC

(57) ABSTRACT

An anode assembly is provided having a pair of channels; anodes in slidable communication with the channels; conduit to direct carrier gas to the anode; and conduit to remove reaction gas from the anode. Also provided is a method for continuously feeding anodes into a electrolytic bath, the method having the steps of stacking the anodes such that all of the anodes reside in the same plane and wherein the stack includes a bottom anode; contacting the bottom anode with the electrolytic bath for a time and at a current sufficient to cause the bottom anode to be consumed during an electrolytic process; using gravity to replace the bottom anode with other anodes defining the stack.

23 Claims, 6 Drawing Sheets

(56) References Cited

U.S. PATENT DOCUMENTS

| | | | | | |
|---|---|---|---|---|---|
| 5,071,534 | A * | 12/1991 | Holmen | C25C 3/125 | 204/245 |
| 5,456,808 | A * | 10/1995 | Juric | C25C 3/10 | 204/222 |
| 6,063,247 | A * | 5/2000 | Bergmann | C25B 1/26 | 204/243.1 |
| 2009/0301895 | A1 * | 12/2009 | Shimamune | C22B 5/02 | 205/354 |

* cited by examiner

CONSUMABLE ANODE AND ANODE ASSEMBLY FOR ELECTROLYTIC REDUCTION OF METAL OXIDES

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to an electrode assembly for metal oxide reduction, and more specifically, this invention relates to a method and device for continuous replenishment of consumable anodes during electrolytic reduction of metal oxides.

2. Background of the Invention

Electrolysis drives a myriad of non-spontaneous processes, including the generation of hydrogen from water, reclamation of metal from their salts and oxides, and redox reactions generally. For example, electrochemical processes recover high purity metal/metals from waste feeds or ores. Aluminum production is one instance. Reclamation of uranium from used nuclear fuel is another.

Uranium metal reclamation via electrolysis requires specialized conditions, including the use of a molten salt (500-650° C.) electrolyte bath, an inert atmosphere environment, and a remotely operated facility if the uranium has been irradiated. Hazardous off-gases are also generated during electrolysis, including, but not limited to CO, $CO_2$, $O_2$ and $Cl_2$, and combinations thereof.

A myriad of systems and methods exist for subjecting used nuclear fuel to redox reactions associated with electrolysis. Unfortunately, there are drawbacks to many of these systems. For example, the size and bulk of the anodes becomes a limiting factor as to how long the process can continue. Once the anodes are consumed, the process needs to be stopped and new anodes installed before reassembly and start-up can occur.

In other applications, non-consumable anodes fabricated from precious metal are used. This substantially increases the cost of the conversion process, especially if the anode is consumed during an off-normal cell operation. In addition, this possibility necessitates implementing a secondary protective circuit to avoid anode failure.

A need exists in the art for an anode assembly in electrolytic systems that does not need constant, direct hands-on supervision. The system should allow continuous redox processes by automatically deploying replacement anodes into an electrolyte (for example via gravity) without the need to first remove the assembly from the salt bath or otherwise shut down the reaction. Further, the system should effectively remove or otherwise manage any corrosive off-gases while confined to hot-cells, gloveboxes, and/or other enclosures.

SUMMARY OF INVENTION

An object of the invention is to provide anode assemblies for electrolytic reactions that overcome many of the disadvantages of the prior art.

Another object of the invention is to provide anode assemblies for use in electrolytic reduction systems. A feature of the invention is that the anode assemblies are removed only for system maintenance or anode replenishment. An advantage of the invention is that the system confers continual use, and consumption, of several anodes in serial physical contact with each other during electrolytic processes.

Still another object of the invention is to provide efficient anode assemblies for use in electrolytic processes. A feature of the invention is inclusion of a secondary electrical circuit. An advantage of the invention is that the secondary circuit mitigates parasitic electrochemical reactions at the anode.

Yet another object of the present invention is to provide an anode storage, transport, and consumption assembly. A feature of the invention is that it enables additional anodes to be added to a salt bath without removing the entire assembly from the bath. Anode replenishment may occur while the system continues to operate. Another feature is that it yields less corrosive off-gas compared to state of the art systems. An advantage of the invented system is that it is a self-perpetuating anode supply system that can be used in a hot-cell facility designed for treating irradiated materials.

Briefly, the invention provides an anode assembly comprising a pair of channels; anodes in slidable communication with the channel, conduit to direct carrier gas to the anode; and conduit to remove reaction gas from the anode.

Also provided is a method for continuously feeding anodes into a electrolytic bath, the method comprising stacking the anodes such that all of the anodes reside in the same plane and wherein the stack includes a bottom anode; contacting the bottom anode with the electrolytic bath for a time and at a current sufficient to cause the bottom anode to be consumed during an electrolytic process; conduit to direct carrier gas to the anode; and conduit to remove reaction gas; using gravity to replace the bottom anode with other anodes defining the stack, whereby the method can be operated remotely.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
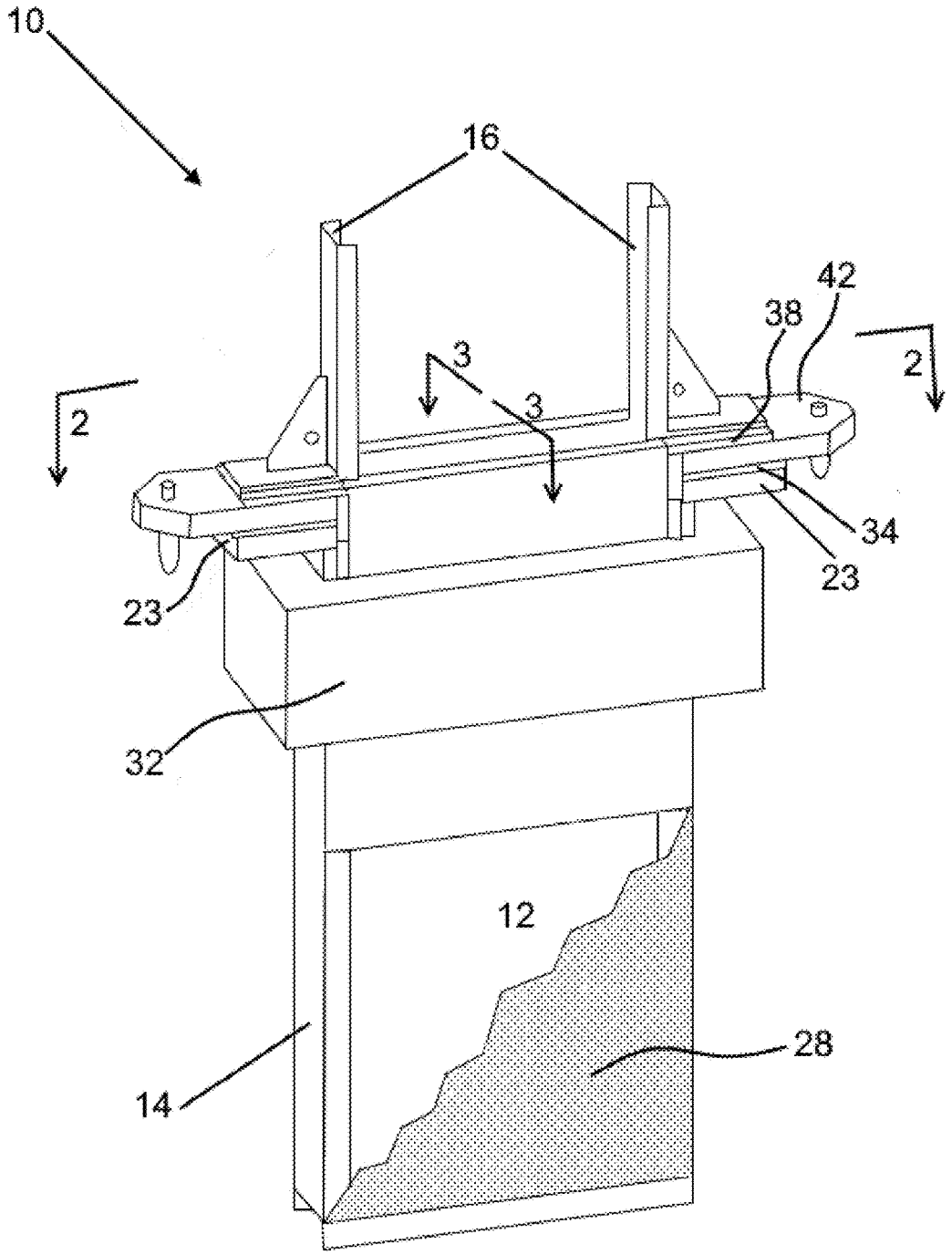
FIG. 1 is a perspective view of the anode and its support structure, in accordance with features of the present invention.

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one skilled in the art would consider equivalent to the recited value (e.g., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invented anode assembly is a salient feature of an electrolytic reducer. The electrolytic reducer converts the oxide fuel particles (e.g., used nuclear fuel, ore, etc.) in baskets to a metallic product. It comprises the following elements:

- Crucible that is the vessel containing the molten salt in which the reduction from oxide to metal occurs;
- An outer containment vessel that is capable of containing salt in the off-normal (i.e., accident) case of a crucible breach and supporting the salt crucible, structures that penetrate into it, and external heaters that keep the salt molten;
- Heaters themselves, mounted on the outside of the containment vessel;
- Vessel Cover that provides an upper insulating boundary for the crucible and supports the electrode modules and other equipment mounted there;
- Fuel Basket Modules that contain oxide fuel pieces upon entering the electrolytic reducer as cathodes and contain metal upon exiting to go to an electrorefiner where they serve as anodes;
- Anode Modules that are semi-permanent assemblies within in the Electrolytic Reducer such that the basket module fuel baskets may be inserted between the anodes in order to carry out the reduction process, in which the anodes convert the oxide ions in the salt to CO and CO2 gas;
- Off-gas System to remove the CO and CO2 gas evolved at the carbon anodes in such a way as to minimize contamination of a hot cell, or other enclosures atmosphere, that atmosphere comprised of an inert gas (argon, helium, nitrogen in some cases);
- Instrumentation appropriate for monitoring the integrity of the system and for controlling the electrolytic reduction process; and
- A means of providing the appropriate amounts of electrical power (i.e., current at the appropriate voltages) to the anodes and cathodes.

Typical electrolytic reactions for which the invented assembly facilitates include the cathodic reduction of metal salts or oxides (e.g., uranium oxides) such as those depicted in Equations 1-3, to wit:

$$UO_2(s)+4e-=U(s)+2O^{2-}(l) \text{ cathode reaction} \quad \text{Eq. 1}$$

$$C(s)+2O^{2-}=CO_2(g)+4e- \text{ anode reaction} \quad \text{Eq. 2}$$

$$UO_2(s)+C(s)=U(s)+CO_2(g) \text{ overall reaction} \quad \text{Eq. 3}$$

wherein $Li_2O$—LiCl molten salt is utilized as the electrolytic bath. CO or $CO_2$ gas is generated at the anode, while uranium ions (or whichever target metal) are converted to metal at the cathodic reduction surface.

Several anode assemblies, one such assembly depicted as numeral 10 in FIG. 1, are semi-permanently installed in the electrolytic system and are only removed for maintenance or replacement. The assembly does not have to be removed to replenish anodes to the salt bath. In an embodiment of the invention, replenishing anodes can be added during electrolysis inasmuch as the replenishing anodes are superior to the anodes partaking in the reaction.

Generally, the configuration of the assembly allows its depending end to become immersed in the crucible containing the electrolyte bath. It is generally flat or planar in construction so that it does not physically contact the sides, bottom or top of the crucible. Optionally, the crucible is surrounded by a spill container or overflow vessel (not shown) so as to contain any wayward electrolyte (due to splashing or a crucible breach) within its confines. During electrolysis, the bottom end (e.g., depending end) of the anode is consumed in a tapered fashion, thereby resulting in the formation of a horizontally extending "knife edge." The anode continues to be consumed in this matter until it is replaced by a second, downwardly biased anode.

Each of the assemblies are adapted to receive a plurality of anode slabs 12; for example slabs comprising graphite. In the embodiment as shown, the anode containment structure defines opposing channels 14 (serving as anode slab guides) to provide a means for the slabs 12 to be slidably received by the assembly 10, such that the slabs 12 are loaded into the assembly from above. As such, the channels are spaced apart at a distance slightly greater than the width of the slabs. It should be noted that while the anodes are loaded with the intention that they do not have to be unloaded, the instant configuration allows for any loaded anode slabs to be easily removed, without the need for disassembly of the system. In summary of this point, a feature of the invention is that the invented configuration allows continual easy access to the anode feed mechanism to confer easy manipulation and continual replenishment of the anodes.

The slabs 12 are stacked upon each other with the upwardly extending edge of a first slab in physical contact with the depending (i.e., downwardly facing) edge of a second slab positioned above the first slab. Opposing edges of adjacent slabs define a tongue and groove configuration. This configuration confers additional stability and alignment to the stack of anode slabs, and also enhances electrical conductivity between slabs. (The maximum number of slabs simultaneously loaded within the assembly is dependent upon the dimensions of the assembly.)

In an embodiment of the invention, the channels are adapted to receive brushes or other electricity conducting structures. Upwardly extending portions 16 of the channels 14 are lined with electrical isolators 44 (FIG. 5) so as to isolate the current to the anode stack and prevent the anodes from being shorted to another electrical potential. In an embodiment of the invention, medially facing surfaces of the tracks of the channels are electrically lined, and not the laterally facing surfaces.

As the bottom most anode 12 is consumed during electrolytic processes, the anodes above it slide downwardly and toward the salt bath. This motion is caused by gravity, i.e., by the weight of superior positioned anodes relative to those anodes contacting (and being consumed) in the salt bath Current is provided to each anode stack via a brush-type contact situated along each channel. These brushes are designated as numeral 22 in FIG. 5. The brushes 22 comprise a flat base substrate 18 bisected by a medial protuberance 20. The flat substrate 18 and protuberance 20 may be an integrally molded electrically conductive construct. The medially directed protuberance 20 is contiguous with a medially directed tongue 45 formed from medially facing surfaces of electrical insulative material 44. A superior end of the insulative material 44 terminates at the brushes.

Figure 6:
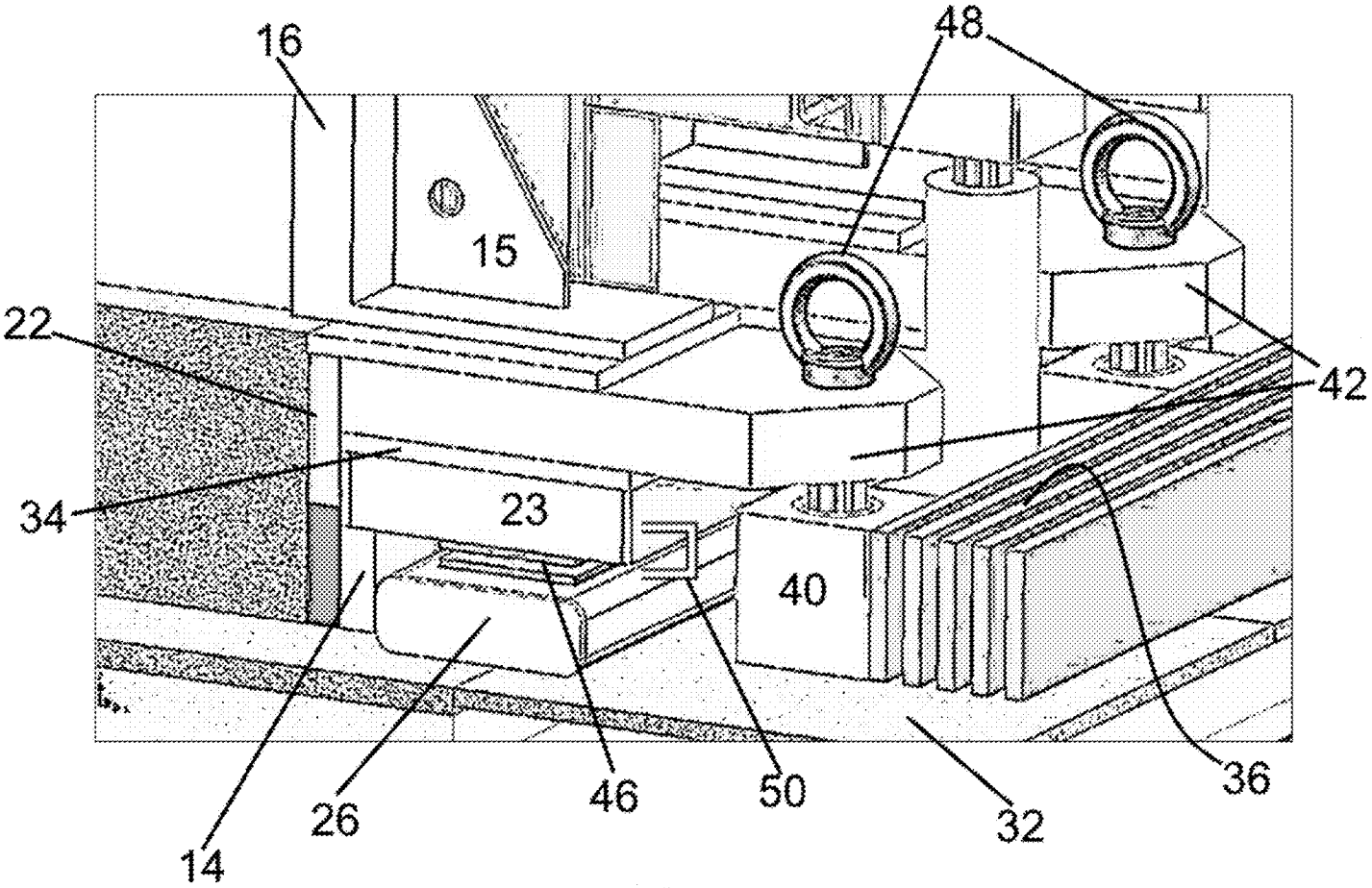
FIG. 6 is a detailed view of electrical connections and routing for an anode assembly, in accordance with features of the present invention.

As depicted in FIG. 6, proximal ends of the contacts are connected, via pin-type high current connectors 40, to bus-bars 36 that provide power from supplies located remotely, e.g., outside of the system, hot cell, etc. Typically only the bottom most slab contacts the brushes. However, inasmuch as all of the slabs are in physical (and therefore electrical) contact with each other, the entire stack is electrified.

Electron transfer occurs only at the salt/graphite interface. While the system can function with the brushes contacting the salt bath, in other instances, the brushes do not contact the salt bath; otherwise, they may become anodes as well and subject to corrosion/oxidation.

Figure 2:
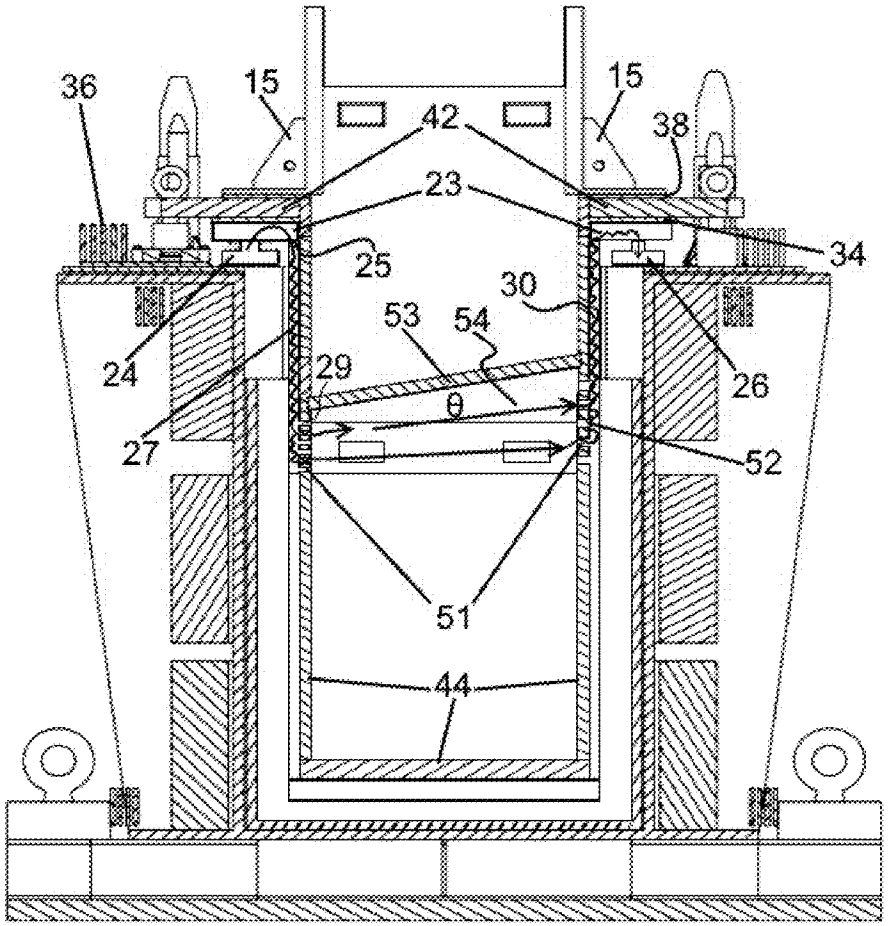
FIG. 2 is a view of FIG. 1 taken along line 2-2.

FIG. 2 further depicts a manifold 23, which defines a means of sweep gas ingress 24 and a means of off gas egress 26. The sweep gas ingress point 24 supplies cell gas (typically inert gas such as argon or helium) to the anodes, via the manifold 23. The sweep gas exits the manifold 23 at a point 25 (such as a one way valve) adjacent to the gas intake manifold 24. The gas traverses a sweep gas conduit 27, the distal end 29 of which terminates in a series of weep holes 51. The sweep gas ingress conduit 27 is shown vertically positioned and laterally disposed, yet generally parallel, to the anode slab guide channel 14. The weep holes define transverse apertures through vertical regions of the anode guide frame 14 situated above the electrolyte bath. An opposing series of weep holes 51 is supplied and defines an off gas ingress point 52 through which gasses emanating from the bath and anode escape the reaction bath atmosphere. An off gas egress conduit 30 directs the off gas from the off gas ingress point 52 to the off gas egress point.

Finally, the off gas egress point 26 removes the sweep gas (plus off-gasses (e.g., CO and $CO_2$) released as part of the oxidation reaction occurring at the anode) out of the system. To facilitate carrier gas and off gas flow through the system, the sweep gas can be supplied at a positive pressure. Alternatively, a vacuum pull or other means for negative pressure, can be applied to the off gas egress point. The arrows in FIG. 2 show the general flow of the sweep gas and off gas through the system.

A generally horizontally disposed nonelectrically conductive substrate/baffle 53 is situated above the anode/electrolyte bath interface to provide a headspace 54 through which carrier and off gas may travel between the weep apertures 51. The substrate/baffle 53 may be positioned at an angle $\phi$ off of horizontal to assure rapid evacuation. The baffle is further positioned and constructed to deflect gas flow off the ceiling of the headspace and toward the laminar flow region of the headspace.

Optionally, ambient cell gas is added to the off gas manifold to keep outlet temperatures below a certain point, that point predetermined by the particular site and to keep carbon monoxide, carbon dioxide, and oxygen concentrations at nonhazardous levels. In an embodiment of the invention, ambient cell gas is added to the egress manifold to assure a maximum outlet temperature of about 150° C.

The anode assembly 10 is depicted in crosshatching in FIG. 2 and shown positioned above the manifold 23. As depicted in FIG. 6, a second bus 46 is positioned between or intermediate laterally extending portions of the anode assembly frame 14 and the manifold 23. The manifold is automatically positioned and functional when the anode assemblies are slid in place to rest on top of the manifold. The manifold is electrically isolated from the anodes and the first or primary bus bar 36 by insulators 34 shaped as pads. The insulation pads 34 are positioned between the manifold 23, (including the gas ingress point 24 and gas egress point 26) and a first electrical bus 36 which energizes the anode channel structure 14. FIG. 6 depicts the insulation pads 34 positioned intermediate to the anode power supply block 42 and the anode channel structure 14. This insulator 34 separates the anode power from the lower guard amperage of the channel structure, to which the shroud attaches. As such, the anode channel structure is electrically isolated from the main current provided by the first or main bus 36.

Lifting rings 48 may be provided to facilitate replacement of the assembly 10 in the event of a failure or off normal occurrence. The rings 48 may be threadably and removably received by a threaded aperture formed in the power supply block 42 or integrally molded with the block.

In an embodiment of the invention, the manifold is rectangular in configuration so as to be mounted on both sides of the anode assembly. As such, the insulation pad 34 is rectangular in configuration, thereby resembling a flat rectangular gasket.

Another electrical insulator gasket 38 is positioned on an upwardly facing surface of the power supply block 42 so as to be sandwiched between the supply block 42 and medially biased extending support struts 15 for the upwardly extending regions 16 of the anode support channels 14. The entire structure is supported by rigid, thermal insulating support blocks 32, discussed infra.

Shroud Detail

The lowest graphite slab (i.e., the one that is immersed in the salt) is maintained within the salt bath via the vertically extending members of the anode support channels 14, such that these lower extending channels are not in electrical communication with the upwardly extending channels 16 discussed supra. Preferably, the brushes are not immersed in the salt. Electrical contact between the upper anode slabs (e.g., those not contacting the bath) and lower immersed slabs is facilitated by contact of horizontally extending edges of adjacent slabs. During portions of an electrolysis run, only one slab may contact the salt bath at any one time. However, depending on the depth of the salt bath crucible, more than one slab may be in contact with the salt bath at a time. If the lower slab has been consumed more than ⅓ its vertical length, then two slabs may be in contact with the salt.

The channels 14 support a porous metal shroud or sleeve 28 (FIGS. 1, 3, 4) such that the shroud opposes the outwardly facing surfaces of the anode but is not directly in contact with the anode. As such, the shroud remains stationary while the anodes are loaded (or unloaded) from the system and/or while the anode stack traverses the channel 14.

Figure 3:
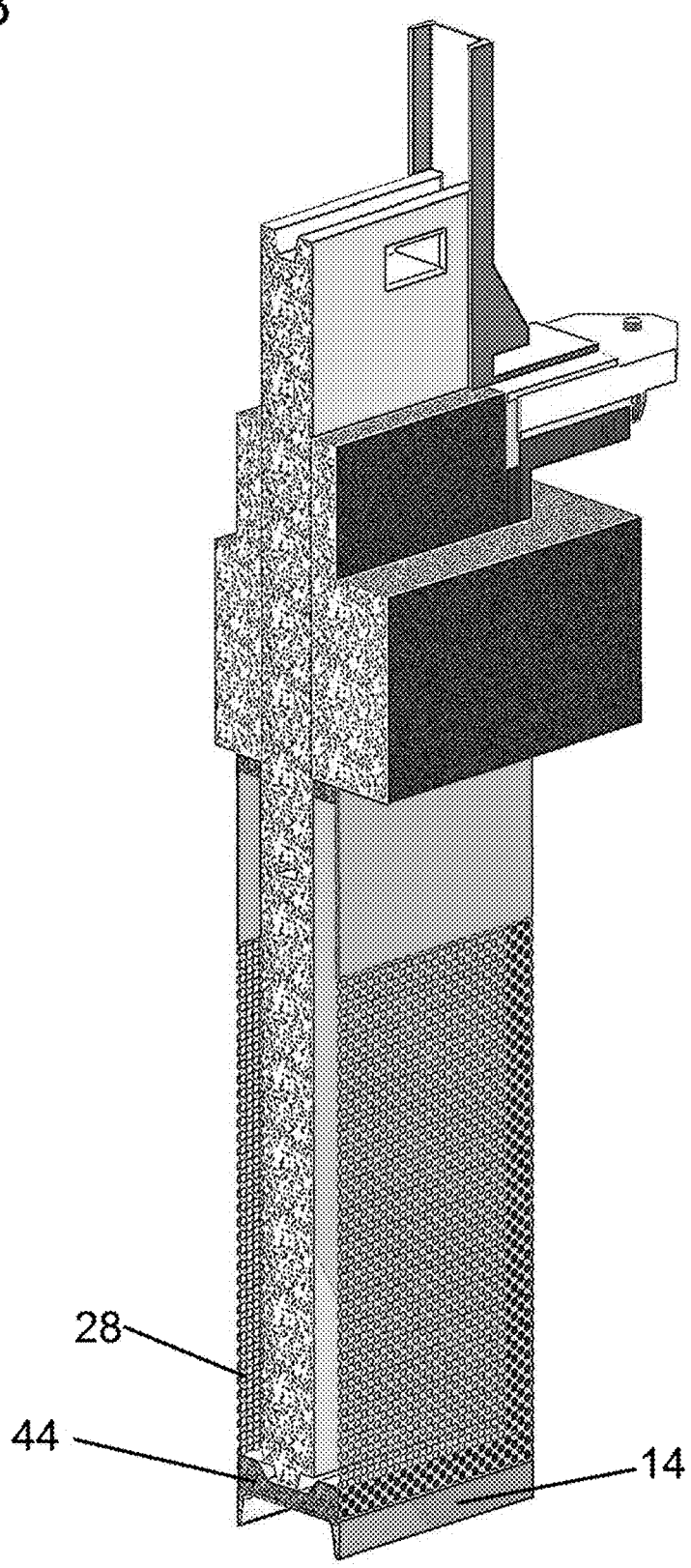
FIG. 3 is a view of FIG. 1 taken along line 3-3.
Figure 4:
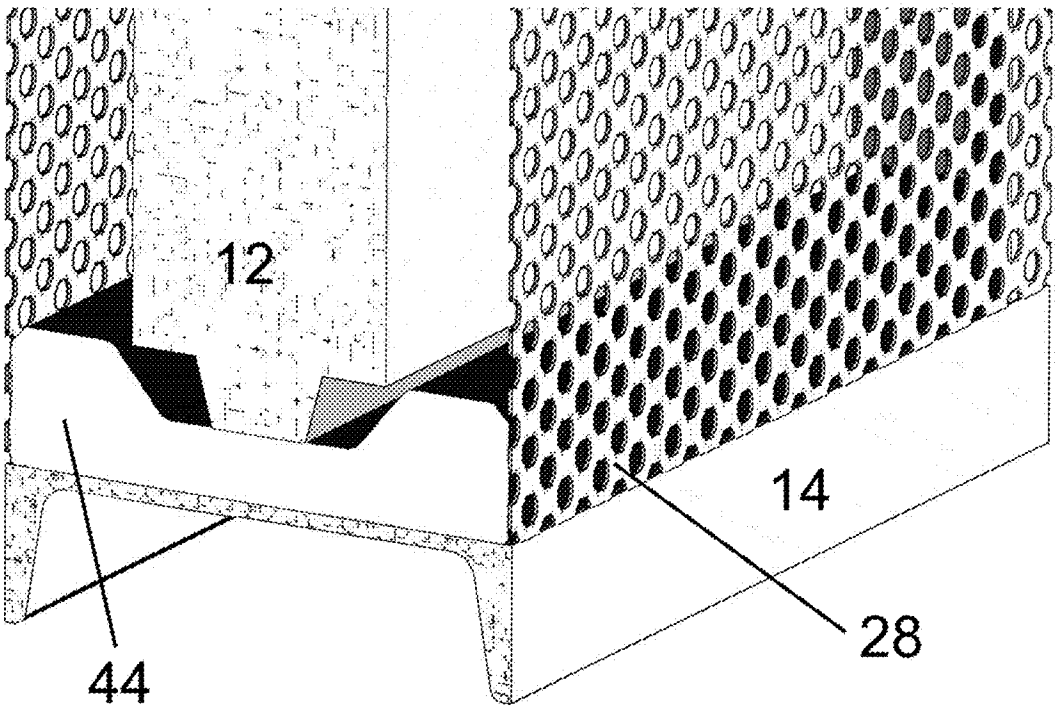
FIG. 4 is a detail view of a depending region of the anode assembly, in accordance with features of the present invention.

As illustrated in FIG. 4, the shroud is contiguous with outwardly facing surfaces of the horizontally disposed portion of the channel 14. FIG. 4 shows electrically insulating material 44 overlaying this horizontal portion of the channel 14. As illustrated in FIG. 3, the shroud 28 overlays outwardly facing surfaces of the vertically disposed channels 14. The shroud defines planar surfaces which both oppose the anode surfaces the shroud overlays, and the electrolyte bath in which the system is immersed. The planar surfaces of the shroud define apertures through which electrolyte may pass so as to make contact with the surface of the anode.

The shroud 28 is adapted to receive and direct any gas generated at the anode surface during the electrolytic process and expel it (along with any sweep gas) from the system. The shroud can also be polarized (e.g. negatively charged) to cathodically reduce any carbonate that forms in the molten salt by a chemical reaction between $CO_x$ and $O^{2-}$ ions.

A salient feature of the shroud 28 is that it prevents pieces of anode from intermingling within the bulk of the electrolyte. Rather, the shroud 28 maintains any anode pieces (which may clone off the bulk anode) in close spatial relation with the bulk of the anode such that those wayward anode pieces continue to facilitate the oxidation reactions occurring at the positive electrode.

The shroud 28 features its own current source, designated as secondary bus 46 in FIG. 6. This current source stymies any parasitic reactions which would otherwise occur at the anode surface and impede the electrochemical (e.g., oxidative) processes occurring at the anode or reductive processes occurring at the cathode.

The shroud 28 in combination with the channels 14 also define longitudinally extending troughs. Feed gas enters the sweep gas intake 24 and travels down one of the troughs and over the anode surfaces to sweep out oxidized moieties (such as CO and $CO_2$). An egress avenue for these oxidized moieties is the second trough, that egress avenue terminating in the off gas egress 26 depicted in FIG. 2. The direction of feed gas, from its introduction, to its expulsion from the anode assembly is depicted as a series of arrows in FIG. 2.

Generally the sweep gas traverses down the vertically disposed channel region proximal to the intake 24, then horizontally above the salt bath surface. Finally, the sweep gas (now entrained with any off gases) traverses up the second vertically disposed channel region proximal to the off gas egress point 26. A means for venting the entrained gas to the atmosphere or a collection system (not shown) may be provided for any additional processing.

Figure 5:
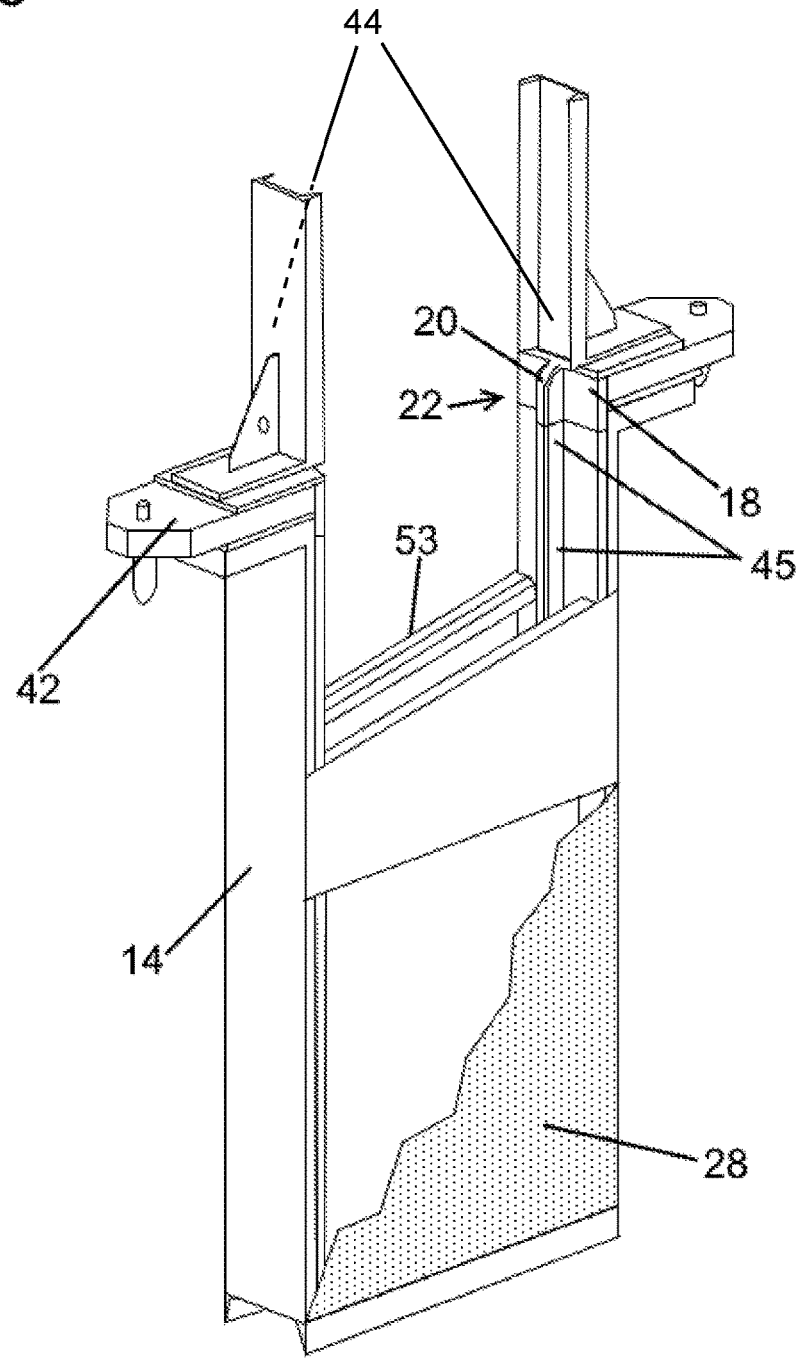
FIG. 5 is a perspective view of an anode shroud, in accordance with features of the present invention.

Turning back to FIG. 4, and as noted supra, depending edges of the shroud 28 may be contiguous with horizontally disposed sections of the channel 14. Also discussed supra, the shroud 28 is laterally disposed from outwardly (i.e., laterally) facing surfaces of the anode 12. This spacing is maintained by the vertically disposed portions of the slab guide channel 14. A bottom or depending edge of the bottom-most anode is supported by a horizontally disposed portion of the slab guide 14. A non-electrically conductive substrate (i.e., an electrical insulator) 44 serving as a catch tray for any anode pieces, is positioned between the anode and the slab guide channel 14 so as to be supported by the guide channel 14. As with vertically disposed regions of the non-electrically conductive substrate, 44, the insulator may overlay the channel so as to be supported thereby. These non-electrically conductive substrates may be removably received by the channels 14 or integrally molded therewith. FIGS. 2, 4 and 5 depict the non-electrically conductive substrate 44 as continuous with the horizontally disposed insulator 38 positioned between the power supply block 42 and laterally directed, medially biased struts 15 of the channel structure 14. As such, the insulator may form an unbroken insulating substrate resembling a "U" so as to completely overlay vertical and horizontal disposed regions of the channel 14.

Suitable electrical insulators 44 are comprised of material having a melting temperature above that of the melt, and include ceramic. As such, this catch tray provides additional means for allowing the loose material too remain in close proximity of the main anode monolith 12 so as to continue to participate in the oxidation processes occurring at the anode. This participation in the oxidation process is facilitated if the loose material is in electrical contact with the anode monolith. This loose material can be consumed by the same anode process as the monolith, instead of being lost in the electrolyte bath.

The entire anode assembly 10 is electrically isolated from aspects of the electro-reducer, such as the crucible, by insulator blocks 32. The insulator blocks are rigid constructs providing electrical isolation from the surrounding objects and capable of withstanding the heating from the mounted surface. Suitable material comprising the insulator blocks include, but are not limited to alumina, zirconia, beryllia, calcium silicate and combinations thereof. Marinite (e.g., BNZ board), for example, is formed from calcium silicate and inert fillers and reinforcing agents.

The insulator blocks 32 are positioned above the insulating vessel cover so as to be in thermal communication with the cover. Aspects of the invention may have the insulator blocks physically contacting the cover. The insulator blocks 32 also minimize upward heat transfer which would otherwise occur via thermal conduction through the anode assembly 10.

In an embodiment of the invention, the insulator blocks are a more permanent part of the entire structure, such that the insulator blocks removably receive the anode assemblies during initial construction and allow for removal of the anode assemblies for maintenance.

EXAMPLE

An embodiment of the invention supports high purity graphite slabs approximately 4 inches thick, by approximately 26 inches wide by approximately 36 inches tall. These dimensions are chosen to fit an assembly 10 of given dimensions. As such, the dimensions provided here are for illustrative purposes only. The graphite serves as the electrical conductor. That portion of the graphite immersed or otherwise in contact with the electrolyte serves as the anode.

The graphite slabs are slidably received by the slab guide channels 14 lined with electrical isolators/insulators. The graphite slab is initially received by upward extending regions 16 of the anode guide channel 14 and as the lower slab is consumed by the reaction, the upper slab slides into the guide channel 14 and contacts the brush assembly. The channels 14 support the superiorly positioned anode slabs until the slabs engage the brushes. The channels may be comprised of any rigid or semi rigid material. The channels may be overlaid with electrically conductive material at regions designated for directly electrifying the graphite slabs from the main bus 36 supply.

There can be a number of graphite slabs coplanarly arranged to each other, depending on the height of the assembly. For illustrative purposes the inventors envision approximately two or more slabs positioned end to end. The slabs gradually slide down into the salt bath as they are consumed by the conversion of oxide ions from the salt into CO (g) and $CO_2$(g).

Opposing ends of two adjacent slabs are configured in a tongue and groove configuration to enhance electrical conductivity to each other. With the above dimensions of the slabs in this example, and given a current of 1000 amps, each slab lasts approximately 1000 hours. As such, consumption of the slabs is occurring at rate of about 9000 amp-hours per kg of anode.

The slabs are constantly sliding down during the electrolysis process, with the rate of movement depending on the consumption of the material.

The assembly can accept one slab or simultaneously accept a plurality of slabs. Also, the slabs may be removed once inserted into the assembly. Optionally, regions of top edges of the slabs may be configured as apertures or some other shape so as to be easily grabbed and pulled from the stack via an overhead handling system, if the slabs need to be removed from the system.

FIGS. 5 and 6 provide detail of the electrical connections and insulations of the invented assembly. Generally the bus bar 36, orthogonally positioned relative to the plane formed by the slabs, energizes an anode power supply pin receptacle 40, which in turn energizes an anode power supply block 42. This first bus bar 36 contacts a laterally facing surface of the pin receptacle such that the bus bar is generally positioned at the extreme lateral region of the assembly.

The figures show the block 42 in physical and electrical communication with the brushes 22. The brush comprises a base substrate 18 bisected by a protuberance 20. The base substrate 18 and protuberance 20 may be integrally molded from electrically conductive material. Alternatively, the protuberance 20 may be removably attached to the base substrate. The base substrate 18 is in electrical communication with the power block 42, and is depicted in physical contact with medially facing aspects of the power block 42. The brush depicted in FIG. 5 defines the protuberance adapted to be received by a groove extending along a longitudinally extending periphery of the anode slab 12. The brushes may reside on one or both sides of the anode slab channel 14 assembly so as to oppose each other across the gap formed by the anode guide fame 14.

FIG. 6 further depicts a second bus bar 46 positioned between the anode guide frame/gas manifold construct 14/23, and the gas egress means 26. Inasmuch as the shroud is physically connected to the frame 14, this secondary bus positioning provides a means for electrifying the shroud (i.e., the perforated substrate) via a separate secondary circuit to prevent parasitic reactions from occurring at the anode and cathode. The frame gas manifold construct 14/23 is therefore maintained at the same electrical potential as the second bus bar in physical contact with it.

The anode guide frame/gas manifold construct, 14/23, is in fluid communication with the gas egress manifold via a conduit 50 (e.g., a tube) extending from the manifold 23 to the gas egress manifold 26. One end of the conduit is sealed (e.g., hermetically) to an opening in the manifold 23 so as to be in fluid communication with the interior of the manifold. The conduit 50 is routed from the manifold 23 to the gas egress manifold 26. The conduit could extend around the bus bar (as shown) or through the secondary bus bar, 46, to mate with the gas egress manifold 26. If the conduit travels through the bus bar, it would do so via a transversely extending aperture or hole through that secondary bus bar 46. The hole in the secondary bus bar, 46, is sized slightly larger than the connecting tube. A similar connection is found between the anode guide frame/gas manifold, 14/23, and the gas ingress manifold 24.

The inter-manifold connection 50 described supra may be reversible, such that either or both ends of the conduit 50 may be detached from their respective manifold terminus point so as to facilitate easy dissembly of the system. Standard plumbing couplers, snap-fit configurations and other reversible connection configurations are suitable means for attaching and detaching the conduit 50 to and from the manifolds. FIG. 6 depicts the conduit 50 positioned below the power block 42, and above the insulator block. The conduit is further positioned medially from the pin receptacle 40 with clearance adequate to allow the anode slab guide channel to be lifted from the assembly via the lifting rings 48.

The conduit 50 connecting the manifold to the ingress or egress portals can be constructed of electrically conductive material or electrically insulative material.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. An anode assembly comprising:

a. a pair of vertically extending channels and a horizontally disposed channel;

b. vertically stacked anodes in slidable communication with the vertically extending channels and supported by the horizontally disposed channel such that the stacked anodes form a vertically extending surface adapted to contact molten electrolyte;

c. conduit to direct carrier gas to the anode; and d. conduit to remove reaction gas from the anode.

2. The anode assembly as recited in claim 1 wherein the anodes reside in the same plane within the channels.

3. The anode assembly as recited in claim 2 wherein a lower region of the assembly is adapted to be immersed in an electrolytic bath such that two adjacent anodes among the stacked anodes simultaneously contact the electrolyte.

4. The anode assembly as recited in claim 3 wherein the anodes are gravity fed into the electrolytic bath.

5. The anode assembly as recited in claim 1 wherein the anode is maintained at a first electrical potential and wherein a lower region of the assembly is encapsulated by a porous, electrically conductive substrate maintained at a second electrical potential.

6. The anode assembly as recited in claim 5 wherein the perforated substrate defines a vertically disposed region adapted to receive pieces of anode and prevent the pieces from contacting target metal forming at the cathodes.

7. An anode assembly comprising:

a. a pair of channels;

b. anodes in slidable communication with the channels;

c. conduit to direct carrier gas to the anode; and d. conduit to remove reaction gas from the anode, and wherein a lower region of the assembly is encapsulated by a porous, electrically conductive substrate and wherein the porous substrate is electrically isolated from the anode and charged via a separate secondary circuit to prevent parasitic reactions from occurring at the anode and cathode.

8. The anode assembly as recited in claim 7 wherein the anodes reside in the same plane within the channels.

9. The anode assembly as recited in claim 7 wherein a lower region of the assembly is adapted to be immersed in an electrolytic bath.

10. The anode assembly as recited in claim 9 wherein the anodes are gravity fed into the electrolytic bath.

11. The anode assembly as recited in claim 7 wherein the porous substrate defines a horizontally disposed region adapted to receive pieces of anode.

12. A method for continuously feeding a first plurality of anodes into a electrolytic bath, the method comprising:

a) stacking anodes vertically such that all of the anodes reside in the same plane and wherein the stack includes a bottom anode and an adjacent anode and wherein the stack is supported at a depending edge of the bottom anode;

b) contacting the bottom anode and the adjacent anode with the electrolytic bath for a time and at a current sufficient to cause the bottom anode to be consumed during an electrolytic process, wherein the adjacent anode contacts the bath at a time when at least ⅓ of the vertical length of the bottom anode has been consumed;

c) using gravity to replace the bottom anode with other anodes defining the stack.

13. The method as recited in claim 12 wherein a pair of channels maintain the anodes in the same plane.

14. The method as recited in claim 12 further comprising continually removing product gases emanating from the contacted bottom anode.

15. The method as recited in claim 12 wherein all of the anodes continually move toward the electrolytic bath during electrolysis.

16. The method as recited in claim 12 wherein a second plurality of anodes can be added during electrolysis.

17. The method as recited in claim 12 wherein anodes can be added during electrolysis.

18. The method as recited in claim 12 further comprising continually removing off gas from anode surfaces.

19. The method as recited in claim 12 further comprising capturing anode pieces from the anodes during electrolysis and consuming those pieces in the redox reactions of the electrolytic process.

20. The method as recited in claim 19 wherein the capturing process comprises:

d) maintaining the anode at a first electrical potential;

e) surrounding the maintained anode with a vertically extending shroud that is maintained at a second electrical potential.

21. The method as recited in claim 20 wherein the shroud is adapted to allow electrolyte and ions to pass through it, while simultaneously preventing pieces of anode and target metal from passing through it.

22. The method as recited in claim 20 wherein the first electrical potential and the second electrical potential are the same.

23. A method for continuously feeding a first plurality of anodes into a electrolytic bath, the method comprising:

a) stacking anodes such that all of the anodes reside in the same plane and wherein the stack includes a bottom anode;

b) contacting the bottom anode with the electrolytic bath for a time and at a current sufficient to cause the bottom anode to be consumed during an electrolytic process;

c) using gravity to replace the bottom anode with other anodes defining the stack;

d) capturing anode pieces from the anodes during electrolysis and consuming those pieces in the redox reactions of the electrolytic process, wherein the capturing process comprises maintaining the anode at a first electrical potential and surrounding the maintained anode with a shroud that is maintained at a second electrical potential, wherein the first electrical potential is different than the second electrical potential.

* * * * *